US005700175A

United States Patent [19]

Wang et al.

[11] Patent Number: 5,700,175

[45] Date of Patent: Dec. 23, 1997

[54] FIELD EMISSION DEVICE WITH AUTO-ACTIVATION FEATURE

[75] Inventors: Wen Chun Wang; Tzung-Zu Yang, both of Hsinchu, Taiwan

[73] Assignee: Industrial Technology Research Institute, Hsinchu, Taiwan

[21] Appl. No.: 629,157

[22] Filed: Apr. 8, 1996

[51] Int. Cl.[6] ..... H01J 1/30; H01J 9/18

[52] U.S. Cl. ..... 445/24; 445/52; 315/169.1

[58] Field of Search ..... 445/24, 52; 315/169.1

[56] References Cited

U.S. PATENT DOCUMENTS

| | | | |
|---|---|---|---|
| 5,210,472 | 5/1993 | Casper et al. | 315/349 |
| 5,357,172 | 10/1994 | Lee et al. | 315/167 |
| 5,536,993 | 7/1996 | Taylor et al. | 445/24 |
| 5,628,662 | 5/1997 | Vickers et al. | 445/52 |
| 5,644,195 | 7/1997 | Browning | 315/169.1 |

OTHER PUBLICATIONS

"Field Emission from Microtip Arrays Using Resistor Stabilization" in J. Vac. Sci Tech B vol. 13 No. 2 Mar. 1995 pp. 474–477.

*Primary Examiner*—P. Austin Bradley

*Assistant Examiner*—Jeffrey T. Knapp

*Attorney, Agent, or Firm*—George O. Saile; Stephen B. Ackerman

[57] ABSTRACT

The field emission device includes, in addition to the main, conventional array of field emission devices and its associated driving circuits, an additional, separate, pixel-sized group of field emission devices close to, but separated from, said main array. Electrons emitted by the additional pixel are collected on a separate, non-fluorescent, anode, and additional circuitry is provided, including a feedback loop from a detector of the additional pixel's cathode current to the gate voltage supply of the main array. Consequently, the voltage of the gate lines varies in inverse proportion to the cathode current of the additional pixel. This results in a display whose brightness is constant even when turned on for the first time or after a period of idleness. A method for manufacturing the device is also available.

5 Claims, 4 Drawing Sheets

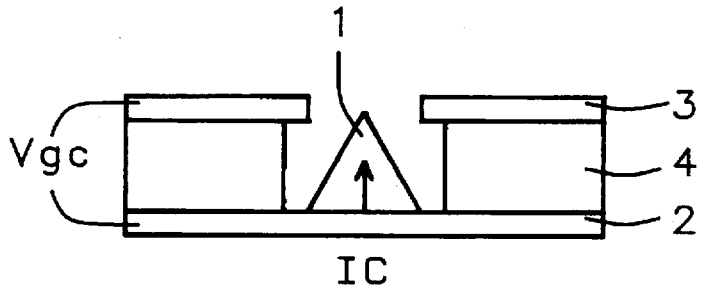
FIG. 1A – Prior Art
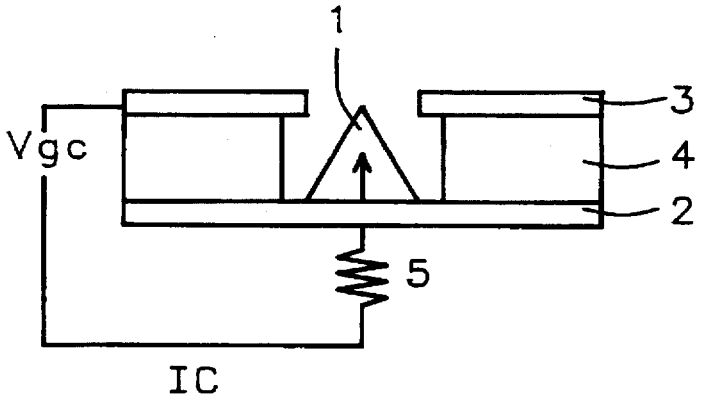
FIG. 1B – Prior Art
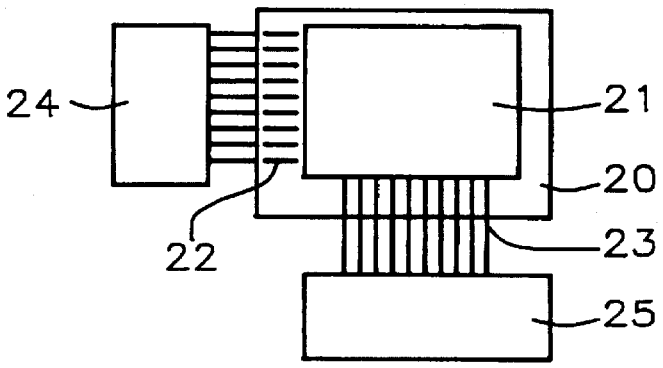
FIG. 2 – Prior Art

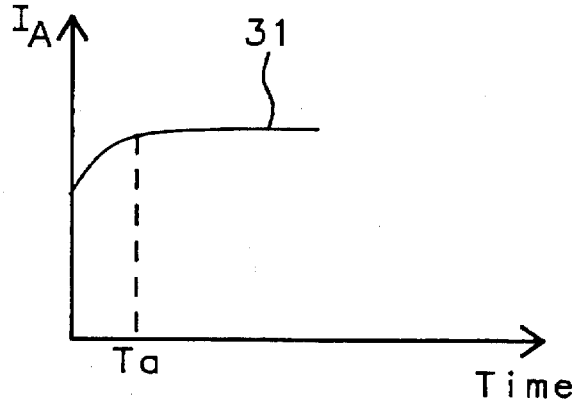
FIG. 3 – Prior Art
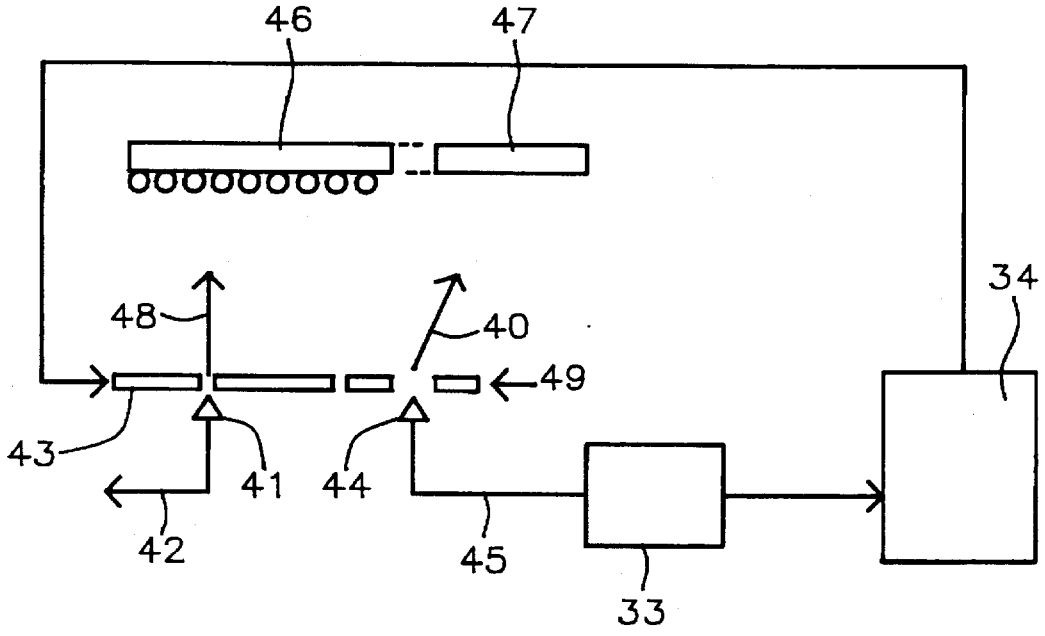
FIG. 4

FIELD EMISSION DEVICE WITH AUTO-ACTIVATION FEATURE

BACKGROUND OF THE INVENTION (1.) Field of the Invention

The invention relates to the general area of field emission devices, more particularly to the question of how to stabilize the cathode currents.

(2.) Description of the Prior Art

Cold cathode electron emission devices are based on the phenomenon of high field emission wherein electrons can be emitted into a vacuum from a room temperature source if the local electric field at the surface in question is high enough. The creation of such high local electric fields does not necessarily require the application of very high voltage, provided the emitting surface has a sufficiently small radius of curvature.

The advent of semiconductor integrated circuit technology made possible the development and mass production of arrays of cold cathode emitters of this type. In most cases, cold cathode field emission displays comprise an array of very small emitters, usually of conical shape, each of which is connected to a source of negative voltage via a cathode line. Another set of conductive lines (called gate lines) is located a short distance above the cathode lines at 90° to them. Where these two sets of lines intersect a large number of conical emitters, or microtips, are located on the cathode lines. The gate lines are connected to a source of voltage that is positive relative to the cathode lines.

The electrons that are emitted by the cold cathodes accelerate past openings in the gate lines and strike a layer of conductive phosphor that is located some distance above the gate lines. One or more microtips thus serves as a subpixel for the total display. The number of subpixels that will be combined to constitute a single pixel depends on the resolution of the display and on the operating current that is to be used.

FIG. 1(*a*) is a schematic diagram of a single field emission device of the above-described setup. Microtip emitter 1 is electrically connected to cathode line 2. Gate line 3, running orthogonal to cathode line 2, is separated from line 2 by insulating layer 4 and is at the height of the tip, or apex, of emitter 1. An opening in line 3 is positioned so that emitter 1 is centrally located beneath it. A plan view of the basic components that comprise the full display is given in FIG. 2. The display panel 21 occupies essentially all of the upper surface of substrate 20. Gate lines 22 are driven by scan driver 24 (which determines when each line is powered) while cathode lines 23 are driven by data driver 25 (which determines the power available to a given line at a given time).

In general, even though the local electric field in the immediate vicinity of a microtip is in excess of several million volts/cm., the externally applied voltage is under a 100 volts. However, even a relatively low voltage of this order can obviously lead to catastrophic consequences, if short circuited. Consequently, a resistor is usually placed between either the cathode lines or the control gate lines and the power supply, as ballast to limit the current in the event of a short circuit occurring somewhere within the display. This is illustrated in FIG. 1(*b*) where resistor 5 has been inserted between cathode line 2 and the power supply.

Ballast resistors can also sometimes be used to alleviate a different problem. When the cathode-gate voltage is applied for the first time, or after the display has been idle for a while, it has been found that, for a fixed applied voltage, the cathode current is initially relatively low but rises for some time until it levels off at its operational, or activated, value $T_a$. This is illustrated in FIG. 3 where curve 31 shows gate emission (in arbitrary units) vs. time in seconds for a typical example of a group of field emitting microtips. $T_a$ typically depends on the vacuum level and on the emitter surface conditions (several minutes for a vacuum of the order of $10^{-7}$ torr). By using a relatively large ballast resistor (typically of the order of several hundred megohms) the cathode-gate circuit can be made to behave as a constant current circuit. Thus, as the tip-to-gate resistance drops, a larger proportion of the applied voltage is dropped across the ballast resistor and the cathode current remains substantially unchanged.

The above described phenomenon of field emitter activation has been described by J. D. Levine et al. in a paper entitled "Field emission from microtip arrays using resistor stabilization" in J. Vac. Sci. Tech. B vol. 13 no. 2 March 1995 pp. 474–477. They attribute the initial high resistance of the field emission device to the presence of adsorbed gas at the surface of the microtip. With time, said gas slowly desorbs and the emission current gradually rises. This hypothesis was confirmed by the fact that they found that for a 10× decrease in base pressure there was a 3× increase in the initial cathode current. Sometimes, the adsorption of electronegative species, after long idle time in poor vacuum, will be more serious and will lead to longer $T_a$. In a manufacturing environment the cost and difficulty of achieving and subsequently maintaining a vacuum less than about $10^{-7}$ torr is high and an alternative solution needs to be found. A solution may be to use a large ballast resistor, as already discussed above. However, this solution to the problem suffers from the major disadvantage that it increases the loading of the data and scan drivers. It needs more power to operate the FED device and has a longer response time.

Several patents have been issued relative to the use of ballast resistors as a means for stabilizing the initial emission current. An example of this is that of Lee et al. (U.S. Pat. No. 5,357,172 October 1994). Casper et al. (U.S. Pat. No. 5,210,472 May 1993) use a pair of series connected Field Effect Transistors to provide regulating resistance in series with each row and column of the display, but the principle is the same.

SUMMARY OF THE INVENTION

It has been an object of the present invention to provide a means for monitoring the performance of field emission devices and to then automatically compensate for unstable effects.

A further object of the present invention has been to provide a field emission device whose brightness does not vary with down time or age.

Yet another object of the present invention is to provide a field emission device wherein fast activation of the microtips is achieved.

A still further object of the present invention has been to provide a method for manufacturing said field emission device.

These objects have been achieved by providing a field emission device comprising, in addition to the main, conventional array of field emission devices and its associated driving circuits, a separate, pixel-sized group of field emission devices close to, but separated from, said main array. Electrons emitted by the separated pixel are collected on a separate, non fluorescent, anode and additional circuitry is provided including a feedback loop that connects a detector of the additional pixel's cathode current to the gate voltage supply of the main array. Thus the voltage of the gate lines varies in inverse proportion to said cathode-to-gate resistance and results in a display whose brightness is constant even when turned on for the first time or after a period of idleness.

BRIEF DESCRIPTION OF THE DRAWINGS

FIG. 1(*a*) shows a single microtip of a field emission device.

FIG. 1(*b*) shows a single microtip of a field emission device, including a ballast resistor.

FIG. 2 is a schematic view of a display panel including scan and data drivers.

FIG. 3 is a plot of emission current with time as seen in the prior art.

FIG. 4 is a schematic cross-sectional view of the principal elements of the present invention.

DESCRIPTION OF THE PREFERRED EMBODIMENTS

Figure 5:
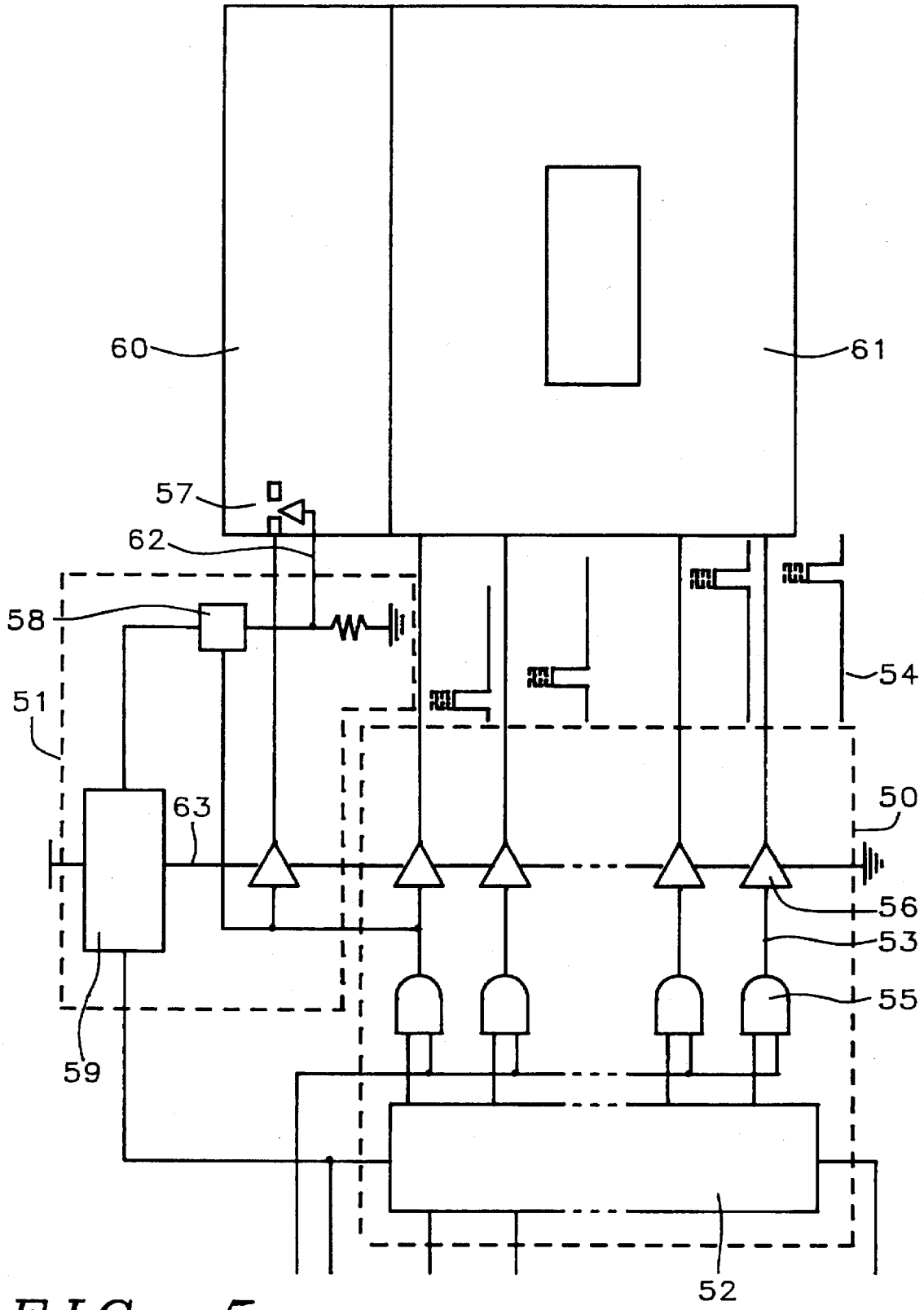
FIG. 5 is a more detailed view of FIG. 4 including the scan drive circuits and the feedback loop introduced as part of the present invention.

As discussed above, the use of a large ballast resistor is helpful in stabilizing the emission current but cannot completely solve the long activation time in the initial emission current. The approach taken by the present invention is illustrated in FIG. 4. Microtips 41 represent a subpixel, one of many that, between them, make up the full (main) display. They are powered from cathode line 42 and gate line 43 and the electron stream 48 that they emit is directed to anode/conducting phosphor 46.

One of the gate lines of the main display, or a fully independent gate line, (designated 49 in FIG. 4) and independent cathode line 45 are arranged to intersect in an area that is close to, but separated from, the main display. A group of additional microtips 44 is formed at said intersection and the electron stream that they emit is directed toward, and collected at, transparent anode 47. Said anode has no phosphor coating but, instead, a layer of indium tin oxide (ITO). Thus cathode current 45 is electrically independent of the main display but, because of it proximity to the latter, will behave in the same time dependent manner as cathode currents in the main display.

A portion of cathode current 45 is now directed to current detector 33 whose output, in turn, controls scan driver 34 of the main array. As the surface condition of microtips 44 changes, current 45 will vary and this is used to bring about a corresponding difference in the voltage outputted by scan driver 34.

FIG. 5 shows a more detailed representation of the relevant circuitry. The schematic encompassed by dotted line 50 represents standard circuitry used in the current art to drive field emission devices. Bidirectional shift register 52 provides a time sequenced set of positive pulses, such as 54, to gate lines such as 53 (after passing through an output enable gate such as 55 and a level shift and output driver such as 56). The voltage level of the cathode lines in the main display depends on image signals.

The schematic encompassed by dotted line 51 represents additional circuitry that has been added in accordance with the teachings of the present invention. A group of microtips such as 57 comprise an additional pixel (having about the same number of microtips as a pixel of the main display) that is located in an area such as 60 which is close to, but separate from, the main display array 61. Typically, the additional groups are located at the corner of the main array and the separation distance between this additional group and the main array is one pixel pitch.

The cathode current 62 from additional pixel 57 is first converted to a voltage signal and then connected to sample and hold device 58 whose output is connected to output voltage selection circuits 59. The latter directs time synchronization information to shift register 52 as well as control information (on output 63) to the output drivers (such as 56) so that the voltage that ends up on the gate lines of the main display varies in inverse proportion to the emission current at any given time of additional pixel group 57. Typically the gate voltage difference is caused to vary over a range of from about 1 volt to about 10 volts.

Manufacture of an embodiment of the present invention begins with the provision of a suitable insulating substrate on whose surface cathode columns are first formed followed by successive depositions of an insulating and a conductive layer. The conductive layer is then patterned and etched to form gate lines orthogonally disposed relative to said cathode columns. Next, a plurality of openings is formed in the gate lines wherever gate lines and cathode columns intersect. Using the etched conductive layer as a mask, the insulating layer is etched down to the level of the cathode columns followed by overetching so that the openings etched in the insulating layer have a greater diameter than the openings in the conductive layer. Finally, a plurality of microtips is formed which connect to the cathode columns and are individually located inside the openings.

Using similar techniques to those just described, an additional group of field emission devices is then formed in an area close to, but separated from the main array. A conductive phosphor screen is then permanently positioned directly above the main array at a distance of between about 0.2 and 10 mm. from it. Similarly, a transparent anode (usually ITO on glass) is permanently positioned above the additional group of microtips. Said transparent anode may be formed on the substrate that is used to support the phosphor screen or, alternatively, it could be formed on its own separate substrate. A cover plate is now positioned over the resulting assembly. The inter-substrate space between the cover plate and the lower substrate is now suitably enclosed and sealed in a vacuum that is less than about $10^{-6}$ torr.

As already described above, standard circuitry for driving the main array, including means for applying a voltage to the gate lines, is provided along with additional circuitry that detects the emission current of the additional pixel. Finally, a feedback connection is made such that the gate voltage in the main display will vary in inverse proportion to the emission current of the additional pixel.

Figure 6:
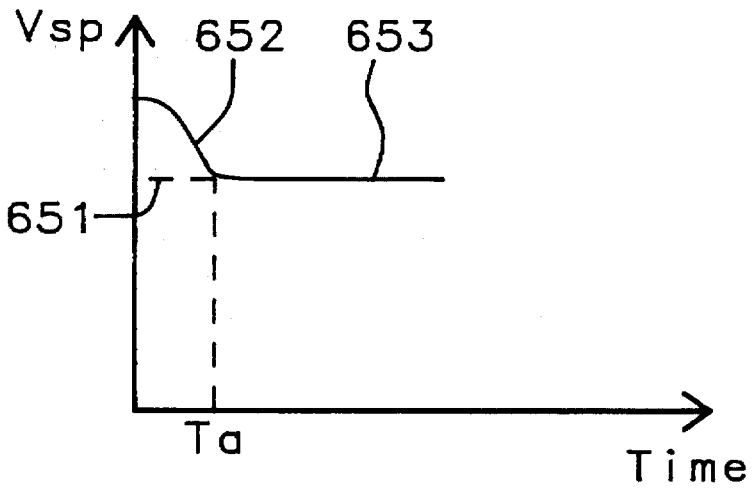
FIG. 6 is a plot of the scan drive peak voltage with time.

As a further aid to understanding the improvements introduced through use of the present invention, we refer now to FIG. 6. This shows a plot of the scan drive peak voltage as a function of time. In displays of the current art this would be a combination of curves 651 and 653, that is the voltage would be time independent. By feeding back information from a separate additional pixel the curve of FIG. 6 takes the form of curve 652 leading into curve 653. That is, the voltage is now time dependent, said dependency being a function of the emission current of the additional pixel.

Figure 7:
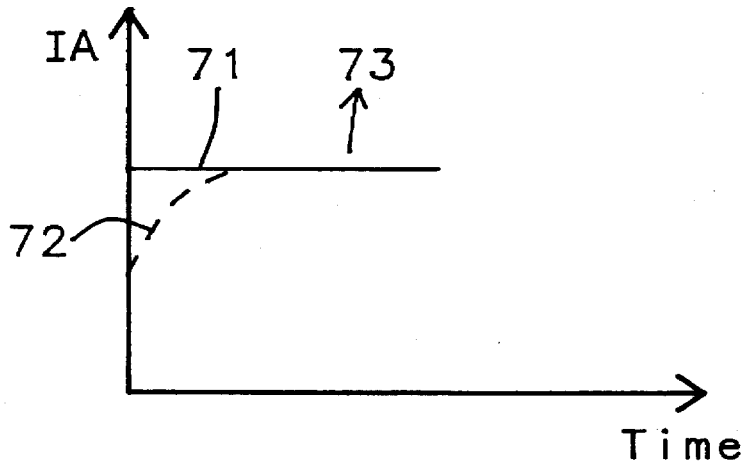
FIG. 7 is a plot of emission current with time that shows the result of applying the present invention.

The consequences of using a time dependent scan drive peak voltage curve to drive the main display are seen in FIG. 7 which is a plot of emission current with time similar to FIG. 3. shown earlier. The curve assumes that the image signal at the cathode lines remains at the same level. In a display based on the current art, the curve would be compounded of curve 72 leading into curve 73, implying that the brightness of the display is changing with time, whereas in the embodiments of the present invention this curve is flat (curve 71 leading into curve 73) implying an unchanging brightness over time.

While the invention has been particularly shown and described with reference to the preferred embodiments thereof, it will be understood by those skilled in the art that various changes in form and details may be made without departing from the spirit and scope of the invention.

What is claimed is:

1. A method for manufacturing a cold cathode array comprising:

(a) providing an insulating first substrate having an upper surface;

(b) forming a main array of field emission devices on part of said upper surface and providing gate lines;

(c) forming an additional group of field emission devices on part said upper surface, separated from said main array;

(d) positioning a conductive phosphor screen a short distance directly above said main array;

(e) positioning a transparent anode above said additional group;

(f) providing first circuitry for driving said main array, including means for applying a variable voltage to the gate lines;

(g) providing second circuitry for detecting emission current in said additional group of field emission devices; and (h) connecting said second circuitry to said means for applying variable voltage, thereby causing the gate voltage to vary in inverse proportion to the emission current of said group of field emission devices.

2. The method of claim 1 wherein step (b) further comprises:

forming cathode columns on part of said upper surface;

depositing an insulating layer on said cathode columns;

depositing a conductive layer on said insulating layer;

patterning and then etching said conductive layer to form gate lines orthogonally disposed relative to said cathode columns;

forming a plurality of openings in the gate lines wherever said gate lines and cathode columns intersect;

etching said insulating layer, down to the level of the cathode columns, using said conductive layer as a mask, and then overetching so that the openings etched in the insulating layer have a greater diameter than the openings etched in the first conductive layer; and forming a plurality of microtips, connected to the cathode columns and located inside said openings, one per opening.

3. The method of claim 1 wherein step (c) further comprises:

forming a cathode column on said upper surface, separated from said main array;

depositing an insulating layer on said cathode column;

depositing a conductive layer on said insulating layer;

patterning and then etching said conductive layer to form a gate line orthogonally disposed relative to said cathode column;

forming a plurality of openings in the gate line at the intersection of said gate line and said cathode column;

etching said insulating layer, down to the level of the cathode column, using said conductive layer as a mask, and then overetching so that the openings etched in the insulating layer have a greater diameter than the openings etched in the conductive layer; and forming a plurality of microtips, connected to the cathode column and located inside said openings, one per opening.

4. The method of claim 1 wherein said variable voltage varies in the range of from about 1 to about 10 volts.

5. The method of claim 1 further comprising:

providing a cover plate;

positioning said cover plate over the substrate and above said phosphor layer and said transparent anode, thereby forming an inter-substrate space;

fully evacuating said inter-substrate space; and then sealing said inter-substrate space from the atmosphere so that a vacuum permanently encloses said first substrate.

* * * * *